US006984146B1

(12) United States Patent
Boudreau

(10) Patent No.: US 6,984,146 B1
(45) Date of Patent: Jan. 10, 2006

(54) POWER CONNECTION ASSEMBLY WITH FLUORESCENT MARKINGS

(76) Inventor: Beverly A. Boudreau, 72 Highview Dr., P.O. Box 384, New Gloucester, ME (US) 04260

( * ) Notice: Subject to any disclaimer, the term of this patent is extended or adjusted under 35 U.S.C. 154(b) by 207 days.

(21) Appl. No.: 10/436,693

(22) Filed: May 13, 2003

(51) Int. Cl.
*H01R 3/00* (2006.01)

(52) U.S. Cl. ..... 439/488

(58) Field of Classification Search ..... 439/488, 439/491, 679, 678
See application file for complete search history.

(56) References Cited

U.S. PATENT DOCUMENTS 1,913,072 A * 6/1933 Dunlap ..... 439/488
1,917,638 A * 7/1933 Dieckmann ..... 439/488
2,650,262 A * 8/1953 Abbott ..... 174/66
4,911,652 A * 3/1990 Savoca et al. ..... 439/282
2001/0002774 A1 * 6/2001 Lee ..... 307/147

* cited by examiner

*Primary Examiner*—Phuong Dinh

(57) ABSTRACT

A power connector assembly includes a power cord having a connector end portion integral therewith. The connector end portion includes a plurality of spaced apart prongs extending outwardly therefrom. The connector end portion also has at least one illuminating portion. The assembly also includes a power outlet having a plurality of slots for receiving the plurality of prongs respectively. At least one of the plurality of slots has an illuminating portion for identifying the at least one slot. The power cord is insertable into the power outlet by guiding the at least one illuminating connector end portion toward the at least one illuminating slot portion. The at least one illuminating connector end portion may be disposed adjacent to the plurality of prongs. Alternately, the at least one illuminating connector end portion may be attached to at least one of the plurality of prongs.

18 Claims, 1 Drawing Sheet

POWER CONNECTION ASSEMBLY WITH FLUORESCENT MARKINGS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a power connector assembly and, more particularly, to a power connector assembly with fluorescent markings for assisting to guide a power cord plug into a power outlet.

2. Prior Art

Electrical sockets and plugs are commonly used for joining an electrical appliance or circuit with an electrical outlet such as the common two wire outlet used in the United States for connecting to the 110 volt power connector line. Unfortunately, an electrical power cord having a plug with multiple prongs is often difficult to insert into a power outlet or socket.

Accordingly, it is often difficult for a person to insert an electrical plug correctly on the first try, especially in the dark. Also, persons with deficient eye sight experience difficulties when plugging a power cord into an outlet. This is especially true when plugging an appliance power cord into a power outlet that is hard to reach.

It is well known that a plug only fits into an outlet if the wider prong of the plug lines up with the wider slot in the outlet. Otherwise, the plug cannot be inserted. Since there are two ways to orient the plug, that means that fifty percent of the time, the plug will not go in the first time. This can be frustrating. A person might also worry about damaging the plug if incorrect insertion is attempted.

Prior art attempts to help overcome these shortcoming have been made. For example, U.S. Pat. No. 5,775,935 to Barna discloses a system and method for connecting color-coded cables to a device. In particular, the Barna patent discloses a color-coded system for associating each of a plurality of individual electrical connection parts of a transactional terminal with a particular cable designated for connection with a specific one of the ports. U.S. Pat. No. 6,078,113 to True et al. discloses a power socket with illuminated plug blade slots. Such a patent teaches an illumination mechanism for illuminating the interior area of each plug blade slot. Unfortunately, such a patent requires additional circuitry for supplying power to select color diodes.

Accordingly, there remains a need for providing a power connector assembly that is simple in design while effectively marking a power cord plug having multiple prongs and a power outlet having multiple slots.

BRIEF SUMMARY OF THE INVENTION

In view of the foregoing background, it is therefore an object of the present invention to provide a power connector assembly with fluorescent markings. These and other objects, features, and advantages of the invention are provided by a power connector assembly having a plug or a power cord including a connector end portion integral therewith. The connector end portion includes a plurality of spaced apart prongs extending outwardly therefrom. The connector end portion also has at least one illuminating portion.

A power outlet includes a plurality of slots for receiving the plurality of prongs respectively. At least one of the plurality of slots has an illuminating portion for identifying the at least one slot. The power cord is insertable into the power outlet by guiding the at least one illuminating connector end portion toward the at least one illuminating slot portion. The at least one illuminating connector end portion may be disposed adjacent to the plurality of prongs. Alternately, the at least one illuminating connector end portion may be attached to at least one of the plurality of prongs.

Further, the at least one illuminating connector end portion may have a generally rectangular shape and is preferably attached to an exterior surface of the connector end portion. The at least one illuminating connector end portion is preferably coated with yellow fluorescent paint. Likewise, the at least one illuminating slot portion is preferably coated with yellow fluorescent paint.

The plurality of prongs preferably include a ground prong integral with the at least one illuminating connector end portion. The plurality of slots also preferably include a ground slot integral with the at least one illuminating slot portion so that when the ground prong is aligned with the ground slot, the connector end portion becomes insertable into the power outlet.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout, and prime and double prime notations are used to indicate similar elements in alternate embodiments.

Figure 1:
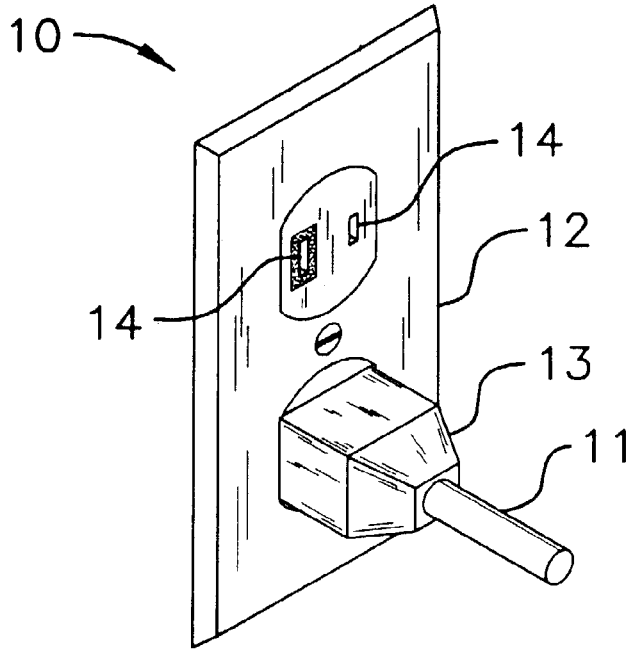
FIG. 1 is a perspective view showing a power connector assembly including a power outlet and a power cord inserted therein, in accordance with the present invention.

The assembly of this invention is referred to generally in FIG. 1 by reference numeral 10 and includes a power cord 11 and a power outlet 12. It is noted that the assembly 10 is intended to provide assistance for connecting the power cord 11 of an appliance (not shown) or other conventional device to the power outlet 12. It should be understood that the assembly 10 may be employed with many different types of power outlets and power cords. For example, the present invention may be used with power outlets supplying 110 volts or 220 volts as well as conventional power outlets including two or three slots. Similarly, the assembly 10 may be used with conventional power cords including two or three prongs, as well known in the industry.

Figure 2:
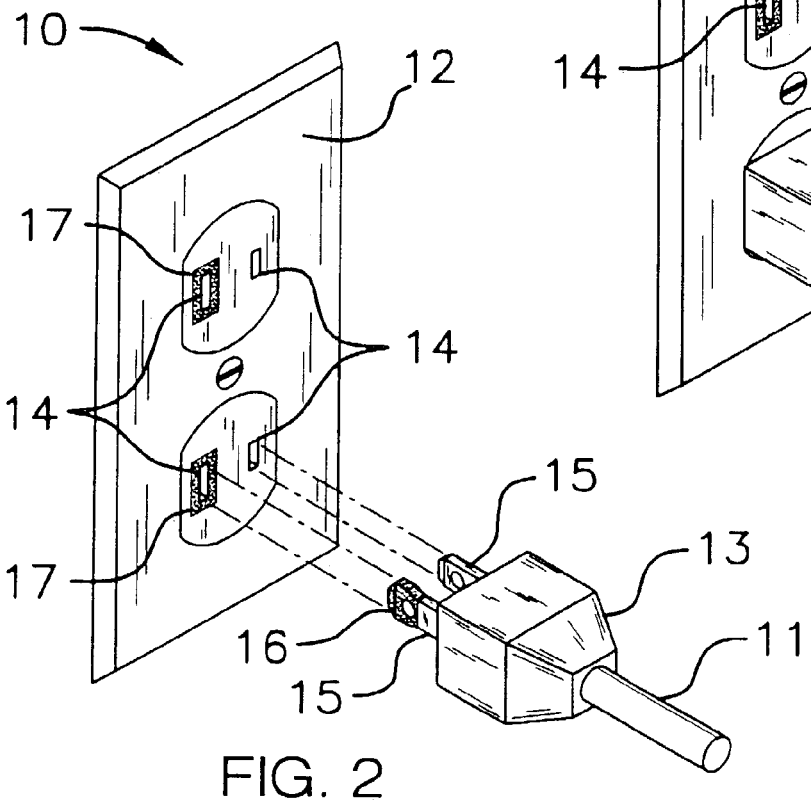
FIG. 2 is a perspective view of FIG. 1 with the power cord removed from the associated power outlet.

As clearly shown in FIG. 1, power cord 11 includes a connector end portion 13 for connecting to power outlet 12. In particular, connector end portion 13 is shown as connected to a lower pair of slots 14 at outlet 12. Now referring to FIG. 2, power cord 11 and the connector end portion 13 are shown has disengaged from the power outlet 12. Power cord 11 includes a plurality of prongs 15, in particular two prongs, extending outwardly from the connector end portion 13. Such prongs 15 are preferably conventional prongs as well known to a person of ordinary skill in the art.

As noted above, power outlet 12 has a plurality of slots 14 with two of such slots located at an upper portion and with two more slots located at a lower portion of the outlet 12, as well known in the art. The slots 14 are sufficiently shaped and sized to receive the pair of prongs 15 extending from the connector end portion 13 to thereby supply electricity to the power cord 11 and an appliance connected thereto. More importantly, one of the prongs 14 is a ground prong and one of the slots 14 is a ground slot. Such a ground slot 14 and a ground prong 15 each include an illuminating portion, as shown at 16 and 17, respectively.

The illuminating portion 17 of prong 15 is integral therewith and preferably includes a coat of paint over an end portion thereof to thereby lead the connector end portion 13 towards the power outlet 12. Likewise, the illuminating portion 17 of the ground slot 14 is coated with fluorescent paint around the periphery thereof for providing a receiving target so that the ground prong 15 can be directed thereto by aligning the illuminating portion 16 therewith. Of course, it is noted that any one of the prongs 15 or any one of the slots 14 may contain an illuminating portion 16, 17, respectively. Furthermore, both prongs 15 and both slots 14 may include an illuminating portion.

Illuminating portions 16, 17 are preferably formed by applying a coat of fluorescent paint or other suitable substance that will glow in the dark or that is easily visible in dark places. The illuminating portions 16, 17 preferably match in color for simplicity. Of course, the size of each illuminating portion 16, 17 may vary. For example, illuminating portion 16 of prong 15 may cover a major portion of the prongs rather than only a minor portion of the prong 15. Likewise, the illuminating portion 17 of the slots 14 may cover a larger portion of the perimeter thereof for providing better visibility in the dark.

Figure 3:
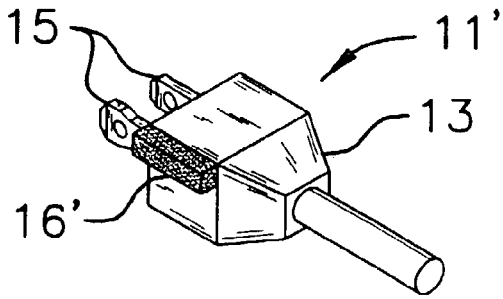
FIG. 3 is a perspective view showing an alternate embodiment of the illuminating connector end portion illustrated in FIG. 1.
Figure 4:
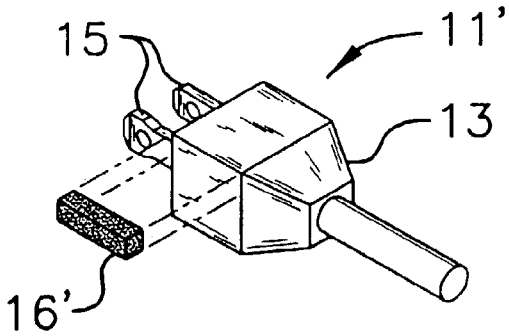
FIG. 4 is a perspective view showing the illuminating portion as detachable from a power cord.

Now referring to FIG. 3, an alternate embodiment of the present invention is shown. In particular, the power cord 11' includes a connector end portion 13 that has an illuminating portion 16' attached to an exterior surface thereof. Notably, the illuminating portion 16' is attached to the plurality of prongs 15, which extends from the connector end portion 13. The illuminating portion 16' has a generally rectangular shape and extends outwardly from a side portion of the connector end portion 13. Such an illuminating portion 16' helps guide the connector end prongs 15 into the associated slots 14 of power outlet 12. Of course, the illuminating portion 16' may be removably attached to connector end portion 13 via a conventional fastener such as an adhesive material or Velcro, as perhaps best shown in FIG. 4. Advantageously, the illuminating portion 16' may be connected to existing power cords as an after market device.

In operation, as in the previous embodiment, the connector end portion 13 should be moved toward power outlet 12 in such a manner so the illuminating portion 16' becomes generally aligned with the illuminating portion 17 of slot 14. This helps the user insert the ground prong into the corresponding ground slot. Of course, the illuminating portion 16' may have different shapes from the particular rectangular shape as shown in FIG. 3. For example, an arrow may be painted on the connector end portion 13, which points parallel to the direction of prongs 15 extending outwardly toward slots 14. In addition, the illuminating portion 16' may have a contoured shape for providing a comfortable grip while inserting the connector end portion 13 into a power outlet 12.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the:

1. A power connector assembly comprising:

a power cord including a connector end portion integral therewith, said connector end portion including a plurality of spaced apart prongs extending outwardly therefrom, said connector end portion having at least one illuminating portion; and a power outlet including a plurality of slots for receiving said plurality of prongs respectively, at least one of said plurality of slots having an illuminating portion for identifying said at least one slot;

said power cord being insertable into said power outlet by guiding said at least one illuminating connector end portion toward said at least one illuminating slot portion;

wherein said at least one illuminating connector end portion is attached to at least one of said plurality of prongs.

2. The power connector assembly of claim 1, wherein said at least one illuminating connector end portion is disposed adjacent to said plurality of prongs.

3. The power connector assembly of claim 1, wherein said at least one illuminating connector end portion has a generally rectangular shape and is attached to an exterior surface of said connector end portion.

4. The power connector assembly of claim 1, wherein said at least one illuminating connector end portion is coated with fluorescent paint.

5. The power connector assembly of claim 4, wherein said fluorescent paint is yellow.

6. The power connector assembly of claim 1, wherein said at least one illuminating slot portion is coated with fluorescent paint.

7. The power connector assembly of claim 6, wherein said fluorescent paint is yellow.

8. The power connector assembly of claim 1, wherein said plurality of prongs includes a ground prong integral with said at least one illuminating connector end portion, said plurality of slots includes a ground slot integral with said at least one illuminating slot portion so that when said ground prong is aligned with said ground slot the connector end portion becomes insertable into the power outlet.

9. A power connector assembly comprising:

a power cord including a connector end portion integral therewith, said connector end portion including a plurality of spaced apart prongs extending outwardly therefrom, said connector end portion having at least one illuminating portion;

a power outlet including a plurality of slots for receiving said plurality of prongs respectively, at least one of said plurality of slots having an illuminating portion for identifying said at least one slot; said at least one illuminating slot portion is coated with fluorescent paint;

said power cord being insertable into said power outlet by guiding said at least one illuminating connector end portion toward said at least one illuminating slot portion;

wherein said at least one illuminating connector end portion is attached to at least one of said plurality of prongs.

10. The power connector assembly of claim 9, wherein said at least one illuminating connector end portion is disposed adjacent to said plurality of prongs.

11. The power connector assembly of claim 9, wherein said at least one illuminating connector end portion has a generally rectangular shape and is attached to an exterior surface of said connector end portion.

12. The power connector assembly of claim 9, wherein said at least one illuminating connector end portion includes fluorescent paint.

13. The power connector assembly of claim 12, wherein said fluorescent paint is yellow.

14. The power connector assembly of claim 9, wherein said fluorescent paint is yellow.

15. The power connector assembly of claim 9, wherein said plurality of prongs includes a ground prong integral with said at least one illuminating connector end portion, said plurality of slots includes a ground slot integral with said at least one illuminating slot portion so that when said ground prong is aligned with said ground slot the connector end portion becomes insertable into the power outlet.

16. The power connector assembly of claim 9, further comprising a fastener attached to said at least one illuminating portion so that same can be removably attached to said connector end portion.

17. The power connector assembly of claim 16, wherein said fastener is an adhesive material.

18. The power connector assembly of claim 16, wherein said fastener is Velcro.

* * * * *